US006199977B1

(12) United States Patent
Komplin et al.

(10) Patent No.: US 6,199,977 B1
(45) Date of Patent: Mar. 13, 2001

(54) CARTRIDGE BODY FOR INK JET PRINTER

(75) Inventors: Steven Robert Komplin; Gregory Alan Long, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/549,110

(22) Filed: Apr. 13, 2000

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | | |
|---|---|---|---|---|
| 5,359,357 | | 10/1994 | Takagi et al. | 347/49 |
| 5,500,664 | | 3/1996 | Suzuki et al. | 347/86 |
| 5,515,086 | | 5/1996 | Kakizaki et al. | 347/50 |
| 5,519,422 | | 5/1996 | Thoman et al. | 347/49 |
| 5,533,904 | | 7/1996 | Nobel et al. | 439/67 |
| 5,539,436 | | 7/1996 | Wilson et al. | 347/37 |
| 5,550,570 | | 8/1996 | Kurata et al. | 347/49 |
| 5,686,947 | | 11/1997 | Murray et al. | 347/85 |
| 5,748,210 | | 5/1998 | Watanabe et al. | 347/50 |
| 5,905,518 | | 5/1999 | DeFilippis | 347/85 |
| 5,948,460 | * | 11/1999 | Takagi et al. | 347/86 |
| 6,086,193 | * | 7/2000 | Shimada et al. | 347/86 |

FOREIGN PATENT DOCUMENTS 622 240 A2 11/1994 (EP) .
0890 442 A1 1/1999 (EP) .

* cited by examiner

*Primary Examiner*—N. Le
*Assistant Examiner*—Anh T. N. Vo
(74) *Attorney, Agent, or Firm*—Michael T. Sanderson; Luedeka, Neely & Graham

(57) ABSTRACT

The invention relates to a molded cartridge body including a substantially one-piece molded polymeric structure defining two or more ink cartridge positions and being removably mountable on a printer carriage. The molded cartridge body has a front panel member opposite a back panel member, side panel members connected to the front and back panel members and a bottom panel member having an ink cartridge side and a printhead side which is connected to a lower edge of each of the front, back and side panel members, the front, back, side and bottom panel members defining an open-ended cavity. The open-ended cavity contains an ink chamber for each of the ink cartridges, each of the ink chambers being in flow communication with a printhead attached to a printhead location on the cartridge body. A needle panel member containing an ink needle for each of the ink chambers is provided, the panel member being attached to the ink chambers so as to define closed ink chambers. Filter elements are disposed in each of the ink chambers between the panel members and the cavities for filtering ink to the printheads. The components of the ink cartridge body promote easy assembly of critical parts and improved yield of useable parts.

26 Claims, 6 Drawing Sheets

CARTRIDGE BODY FOR INK JET PRINTER

FIELD OF THE INVENTION

The invention relates to ink jet printers and to components for the printers which improve the manufacturing and reliability of the assembled components.

BACKGROUND

Ink jet printers continue to evolve as versatile, reliable, low cost printers for a variety of individual and commercial applications. Instead of disposable printheads attached to disposable ink cartridges, permanent or semi-permanent printheads which have longer life than conventional printheads are becoming the printheads of choice. However, because the printheads are no longer disposable commodities which are replaced often, there is less manufacturing tolerance with respect to the printhead, associated components and assembly thereof. Furthermore, the printheads and components are required to maintain tolerances over their life which results in higher parts rejection during the assembly process. One method for maintaining the desired tolerances is to use exotic materials of construction which are more expensive than conventional materials and require more costly manufacturing techniques. As competition increases for low cost, high quality ink jet printers, a need has arisen for unique component configurations which provide reliable components which can be manufactured and assembled at substantially lower cost.

SUMMARY OF THE INVENTION

With regard to the above and other objects and advantages the invention provides a cartridge body for an ink jet printer. The cartridge body includes substantially one-piece molded body structure defining one or more ink cartridge positions. The body structure is mountable on a printer carriage and has a front panel member opposite a back panel member, side panel members connected to the front and back panel members and a bottom panel member having a ink cartridge side and a printhead side connected to a lower edge of each of the front, back and side panel members so as to define an open ended cartridge cavity with the ink cartridge side of the bottom panel member facing the cartridge cavity. One or more printhead locations are provided on the printhead side of the bottom panel member, each printhead location corresponding to an ink cartridge position in the cartridge cavity. One or more ink cavities are disposed in the bottom panel member opposite each of the printhead locations. An ink needle panel member containing an ink needle for each ink cavity is provided, the ink needle panel member being attached to the bottom panel member adjacent the one or more ink cavities providing closed ink cavities. A filter element is disposed in each of the ink cavities for filtering ink to a printhead attached to each printhead location, the filter element being attached to the ink needle panel member.

In another aspect the invention provides a method for constructing a cartridge body for an ink jet printer. The method includes molding a cartridge body from a polymeric material, the molded cartridge body defining one or more ink cartridge positions and being removably mountable on a printer carriage, the molded cartridge body having a front panel member opposite a back panel member, side panel members connected to the front and back panel members and a bottom panel member having a ink cartridge side and a printhead side connected to lower edges of each of the front, back and side panel members so as to define an open ended cartridge cavity with the ink cartridge side of the bottom panel member facing the cartridge cavity. One or more printhead locations are provided on the printhead side of the bottom panel member, each printhead location corresponding to an ink cartridge position in the cartridge cavity. An ink cavity is disposed in the bottom panel member opposite each of the printhead locations. An ink needle panel member containing an ink needle for each printhead location is also provided in the cavity. A filter element for filtering ink to each printhead is disposed in each cavity and is attached to the ink needle panel member. The ink needle panel member is fixedly attached to a peripheral edge of the ink cavity to provide an enclosed ink filter chamber for feeding ink to a corresponding printhead.

In yet another aspect the invention provides a stiffener assembly for stiffening an electrical connection wall of a cartridge body for an ink jet printer, the stiffener assembly including a bottom wall and one or more upstanding dividing walls attached to the bottom wall. The stiffener assembly is adapted for frictional engagement with a cartridge cavity of the cartridge body.

The invention provides components of a cartridge body which can be easily assembled with high accuracy to provide a relatively low cost cartridge body without sacrificing the printer's ability to produce high quality, high speed images. Because of the unique design features incorporated in the components of the cartridge body design, the cartridge body can be molded on high speed molding equipment from relatively inexpensive polymeric materials. The components are amenable to assembly using relatively few assembly steps, yet the assembled components provide a robust design which provides a relatively rigid, inflexible structure for positive electrical contacting surfaces and for alignment purposes within a printer. The component design also provides guides for directing an ink cartridge outlet member in locking engagement with the cartridge body to provide a leak resistant ink flow from the ink cartridge to the printheads.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

DETAILED DESCRIPTION OF THE PREFERRED EMBODIMENTS

Figure 1:
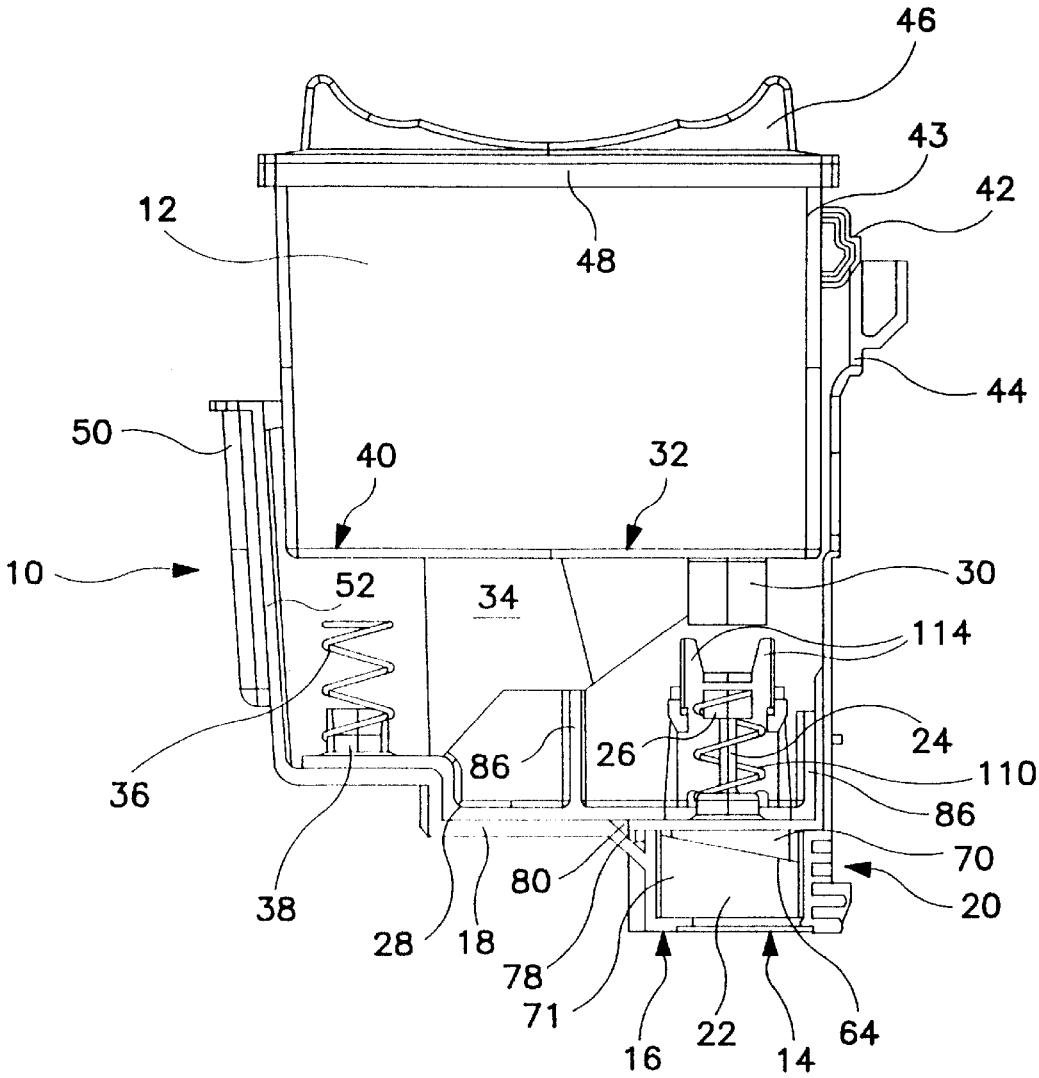
FIG. 1 is a partial cross-sectional side elevational view of a cartridge body and ink cartridge according to the invention.

With reference to FIG. 1, the invention provides a cartridge body 10 for receiving one or more replaceable ink cartridges 12 for supplying ink to corresponding permanent or semi-permanent ink jet printheads 14. The printheads include a semiconductor substrate preferably containing heater resistors or piezoelectric pressure devices and a nozzle plate having a plurality of orifices for ejecting ink toward a print media. The printheads 14 are located on a printhead side 16 of a bottom panel member 18 of the cartridge body 10, and the ink cartridges are removably positionable in the cartridge body 10 so as to supply ink to the printheads 14. It is preferred that the bottom panel member 18 be shaped to provide an extension 20 which provides ink cavities 22 associated with each of the printheads for receiving ink from the ink cartridges 12.

Ink is supplied from the ink cartridges 12 through a needle valve which includes a needle 24 and needle valve seal assembly 26 which is described in more detail below. The needle valve seal assembly 26 is preferably attached to a stiffener insert 28 which is preferably snap-fitted into the cartridge body 10 adjacent the bottom panel 18. The needle 24 and needle valve seal assembly 26 are coupled to a boss fitting 30 extending from a lower portion 32 of the ink cartridge 12 when the ink cartridge 12 is inserted in the cartridge body 10.

As shown in FIG. 1, an ink cartridge 12 is slidably engaged with the cartridge body 10 by substantially vertical movement of the ink cartridge 12 relative to the cartridge body 10. As the ink cartridge 12 is lowered into the cartridge body 10, boss 30 pending from the lower portion 32 of the ink cartridge 12 engages the needle 24 and needle valve seal assembly 26 for fluid flow communication between the ink cartridge 12 to the ink cavity 22.

A cartridge body cavity 34 into which the ink cartridge 12 is placed also contains a cartridge urging member 36 which is attached to the stiffener insert 28 within cavity 34 to yieldably position the cartridge 12 in the body cavity 34. In the case of a coil spring urging member 36, the urging member 36 may be attached to a vertical column 38 pending from the stiffener insert 28. Urging member 36 is positioned to contact the lower portion 32 of the ink cartridge 12 on an end 40 opposite boss 30 so that end 40 is urged away from stiffener 28. Upon urging end 40 away from stiffener insert 28, a latch member 42 attached to a front end 43 of the ink cartridge 12 is caused to positively engage a ledge 44 on the cartridge body 10. Handle 46 is provided on an upper portion 48 of the ink cartridge for assisting in inserting and removing ink cartridge 12 from cavity 34 of the cartridge body 10.

In order to assure proper placement of the ink cartridges 12 in the proper location in cavity 34 of the cartridge body 10, in the case of multiple ink cartridges and multiple ink cartridge locations, a keying member 50 is preferably molded into a back or rear panel member 52 of the cartridge body 10. The keying member 50 is particularly useful with cartridge bodies 10 containing two, three or four ink cartridge locations.

Figure 2:
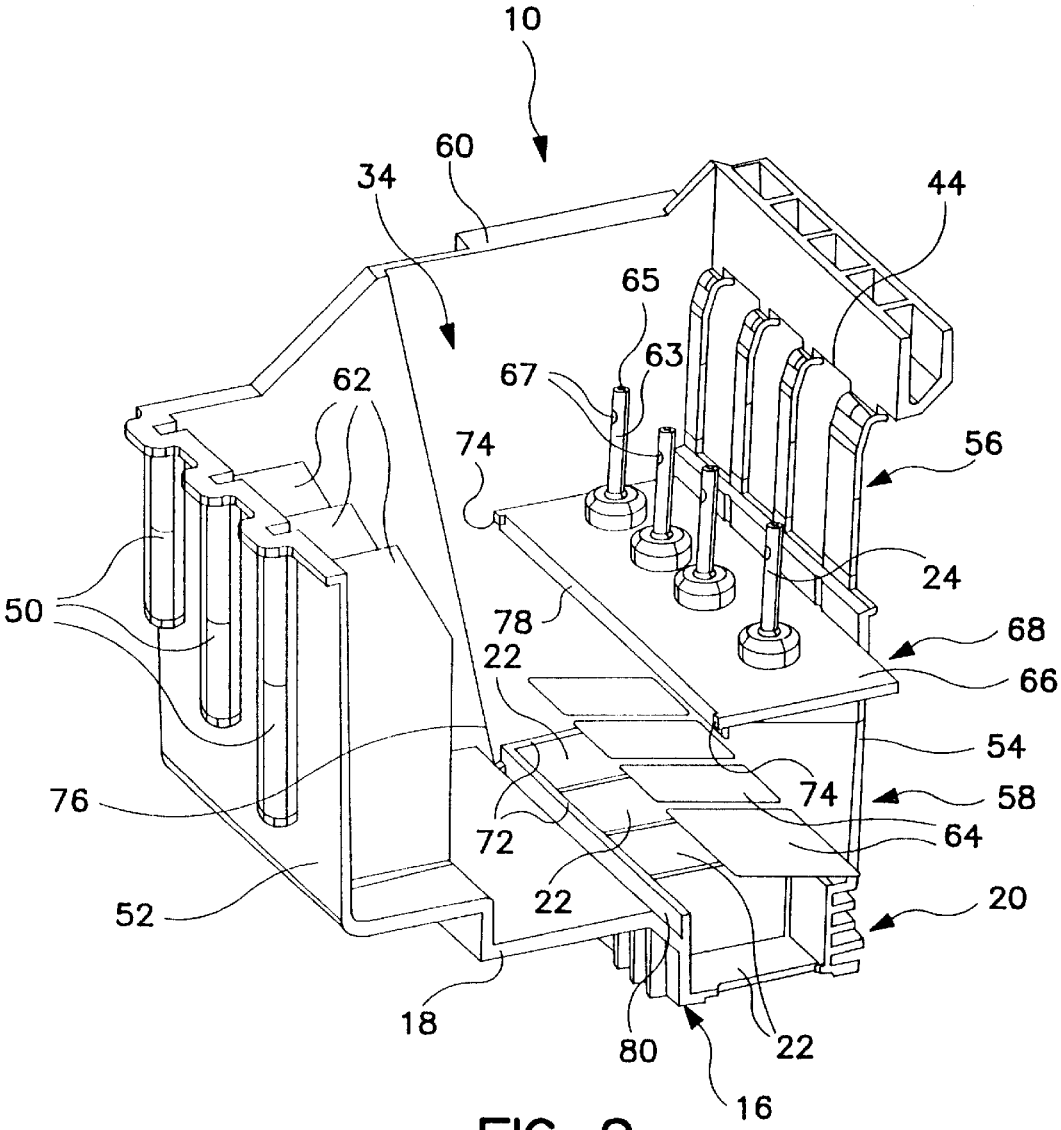
FIG. 2 is a top perspective cut-away view of portions of a cartridge body according to the invention.

As seen in more detail in FIG. 2, the cartridge body 10 is preferably molded from a unitary piece of polymeric material, preferably high density polyethylene, polypropylene, polyvinyl chloride, polyphenylene oxide, modified polyphenylene oxide and the like. The cartridge body contains a bottom panel 18, front panel 54 containing an upper section 56 and a lower section 58, rear panel 52 and side panels 60, one of which is shown. The side panels 60 are attached to the bottom panel 18, rear panel 52 and front panel 54 thereby providing the open-ended cavity 34 for receiving one or more ink cartridges 12 (FIG. 1).

In the case of multiple ink cartridges 12 it is preferred to include divider panels 62 preferably attached to the back panel member 52. The divider panels 62 provide stiffening of the rear panel 52 and effectively guide the ink cartridges 12 into alignment with the ink needles 24 when inserting the ink cartridges 12 into cavity 34. It is preferred that the divider panels 62 be made of the same material as the cartridge body 10 and preferably be formed during molding of the cartridge body 10 rather than being attached to the cartridge body 10 in a separate process step.

As described above, the bottom panel 18 of the cartridge body preferably contains the extension 20. Ink cavities 22, defined within extension 20 are in flow communication with ink needles 24. The ink cavities 22 are preferably integrally molded with the cartridge body 10. Each needle 24 is preferably an elongated hollow cylindrical rod 63 having a substantially rounded or blunt tip 65 and contain an aperture 67 in fluid flow communication with the inside of hollow rod 63.

Each of the cavities 22 preferably contains a filter element such as filter elements 64 attached to the underside of panel member 66 defining a filter tower assembly 68 wherein the filter elements 64 are disposed in the cavities 22 between panel member 66 and ink cavity 22 so as to filter ink entering the cavities 22 from the ink needles 24. The filter elements 64 preferably have a mesh size which is selected to prevent particles having an effective diameter ranging from about 0.1 $\mu$m to about 50 $\mu$m, preferably from about 5 $\mu$m to about 10 $\mu$m from passing through the filter element. The filter element 64 may be made from stainless steel, woven fiberglass, nylon mesh or any other suitable filtration media which is resistant to chemical attack of the ink.

It is preferred to ultrasonically weld or heat stake each filter element 64 to the panel member 66 around the perimeter of the element 64 so as to provide an unfiltered ink section 70 above the filter element 64 and a filtered ink section 71 below the filter element 64 (FIG. 1). It is particularly preferred to dispose filter elements 64 in the ink cavities 22 at an angle with respect to the cavities 22 in order to reduce the blockage of ink flow to the filtered ink section 71 caused by air trapped in the filtered and/or unfiltered ink sections 71 and 70. The invention is not limited, however, to attaching the filter elements 64 to the panel member 66. Ledges may be provided in ink cavities 22 for attaching the filter elements 66 directly to the ink cavities 22.

The ink cavities 22 are separated from cartridge cavity 34 by filter tower assembly 68 which is attached to the peripheral edges 72 of the ink cavities 22. It is preferred to include location pins 74 on one side edge of panel member 66 and corresponding pin receivers 76 adjacent the side panel members 60 and/or bottom panel member 18 of the cartridge body 10. The panel member 66 preferably also contains a tab member 78 which is fittingly received in recess 80 of the bottom panel member 18. The tab member 78 adds strength to the assembly while location pins 74 provide proper alignment of the filter tower assembly 68 with respect to the cartridge body 10 so that the panel member 66 may be sealingly attached to the peripheral edges 72 of the ink cavities 22 as by adhesive, ultrasonic welding and the like.

Figure 3:
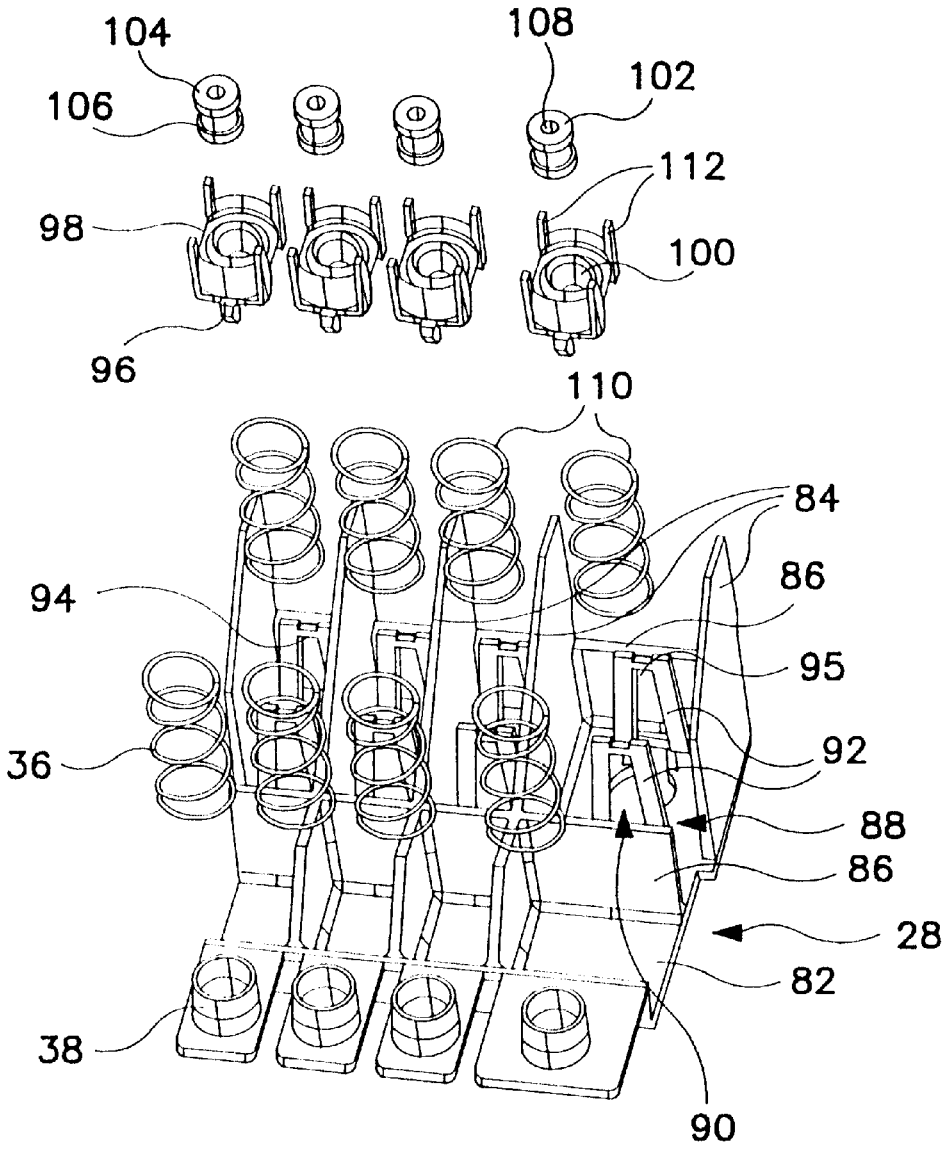
FIG. 3 is an exploded view in perspective of a stiffener structure and valve structure according to the invention.

Referring now to FIG. 3, features of the stiffener insert 28 will be described. The stiffener insert 28 is preferably a one-piece molded body containing a bottom wall portion 82, two or more upstanding dividing wall portions 84 attached to the bottom wall portion 82 and, optionally, one or more upstanding cross wall portions 86 attached to the bottom wall 82 and dividing wall portions 84 transverse to the dividing wall portions 84. The open space between cross wall portions 86 and adjacent dividing wall portions 84 defines needle valve seal assembly areas 88 which contain an opening or aperture 90 in the bottom wall portion 82 for insertion therethrough of ink needles 24 (FIG. 1).

Figure 3A:
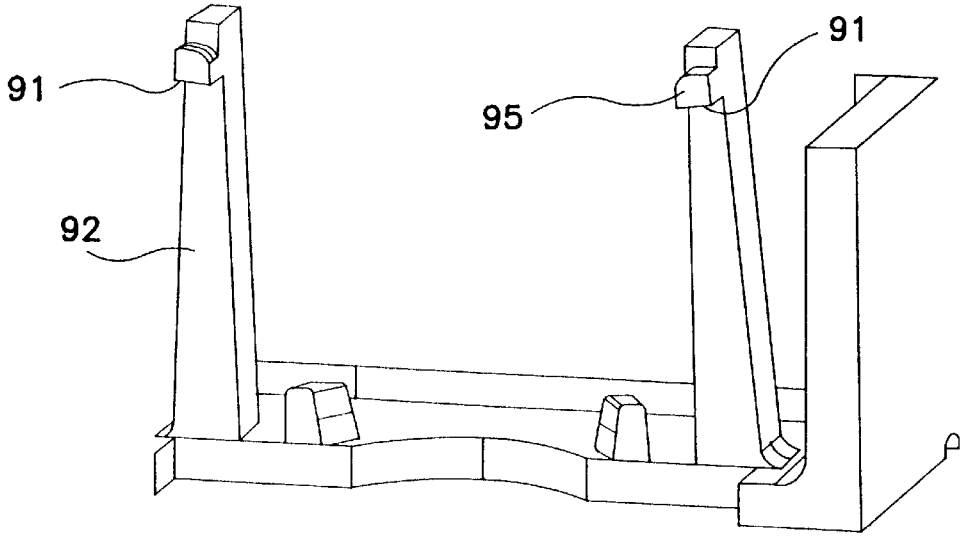
FIG. 3A is a magnified cut portion of a valve guide according to the invention.
Figure 3B:
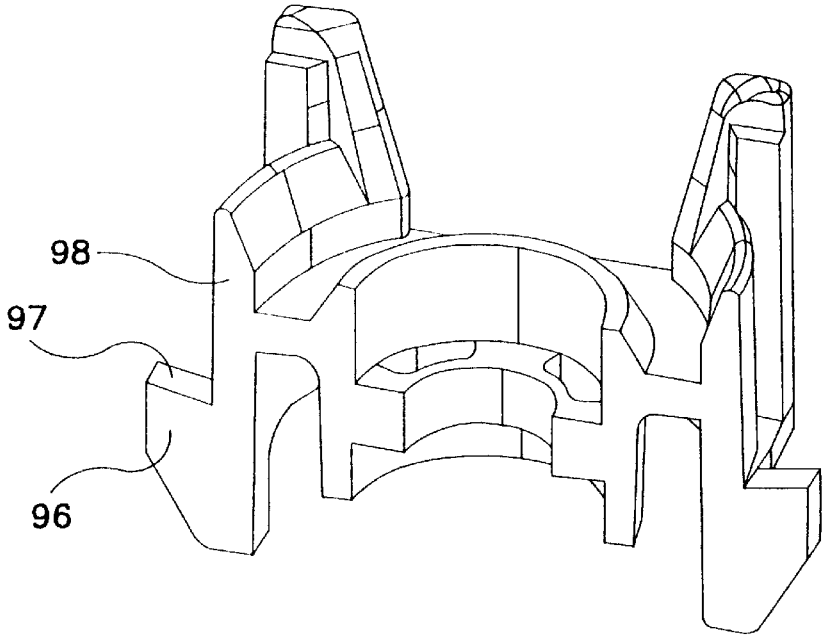
FIG. 3B is a magnified cut view of a seal assembly housing member according to the invention.

Upstanding seal assembly guides 92 are provided pending from bottom wall portion 82 each containing slots 94 for slidably guiding projections 96 on the seal assembly housing members 98. The bottom 91 of the upper cross portions 95 of the seal assembly guides 92 are preferably angled downward toward the guiding projections on the housing members 98, as shown in FIG. 3A, so as to urge the guides 92 toward the housing members 98 during assembly and movement of the housing members 98 with respect to the seal assembly guides 92. The top 97 of guiding projections 96 are also preferably angled in the same direction as the bottom 91 of cross portions 95 to further urge the guides 92 toward each other as shown in FIGS. 3A and 3B. Angling the cross portions 95 and projections 96 as described above inhibits flexure apart of the guides 92.

The seal assembly housing members 98 have apertures 100 therein for retaining molded resilient elastomeric valve sleeves 102 therein. The sleeves 102 are preferably made of natural rubber, synthetic rubber, polyurethane and the like and preferably contain flanges 104 and 106 to resist displacement of the sleeves 102 from engagement with apertures 100. The sleeves 102 also contain apertures 108 for inserting ink needles 24 therethrough, the apertures 108 being sized to sealingly close needle aperture 67 (FIG. 2). The sleeves 102 may alternatively be insert-molded into the housing members 98 in a design similar to that shown in FIG. 3B.

Valve urging members 110 are disposed between each pair of valve guides 92 and between the housing members 98 and the bottom wall portion 82 of stiffener insert 28. The valve urging members 110 are preferably resilient coil springs which urge seal assembly housing members 98 upward in a direction generally away from the bottom wall portion 82 of stiffener insert 28. In the upward position, sleeves 102 providing sealing closure to apertures 67 in needles 24 (FIG. 2) in the absence of an ink cartridge 12 attached to the cartridge body 10. Upon attachment of an ink cartridge 12 to the cartridge body, boss 30 urges seal assembly housing members 98 toward the bottom wall portion 82 thereby promoting ink fluid flow communication between the ink in the ink cartridge 12 and aperture 67 in needles 24 so that ink flows through hollow needles 24 into unfiltered ink cavity 70 (FIG. 1). In order to reduce misalignment between boss 30 and needle 24, each seal assembly housing member 98 preferably includes two or more guiding projections 112, preferably four guiding projections 112 for capturing and guiding boss 30 into proper alignment with needle 24.

Figure 4:
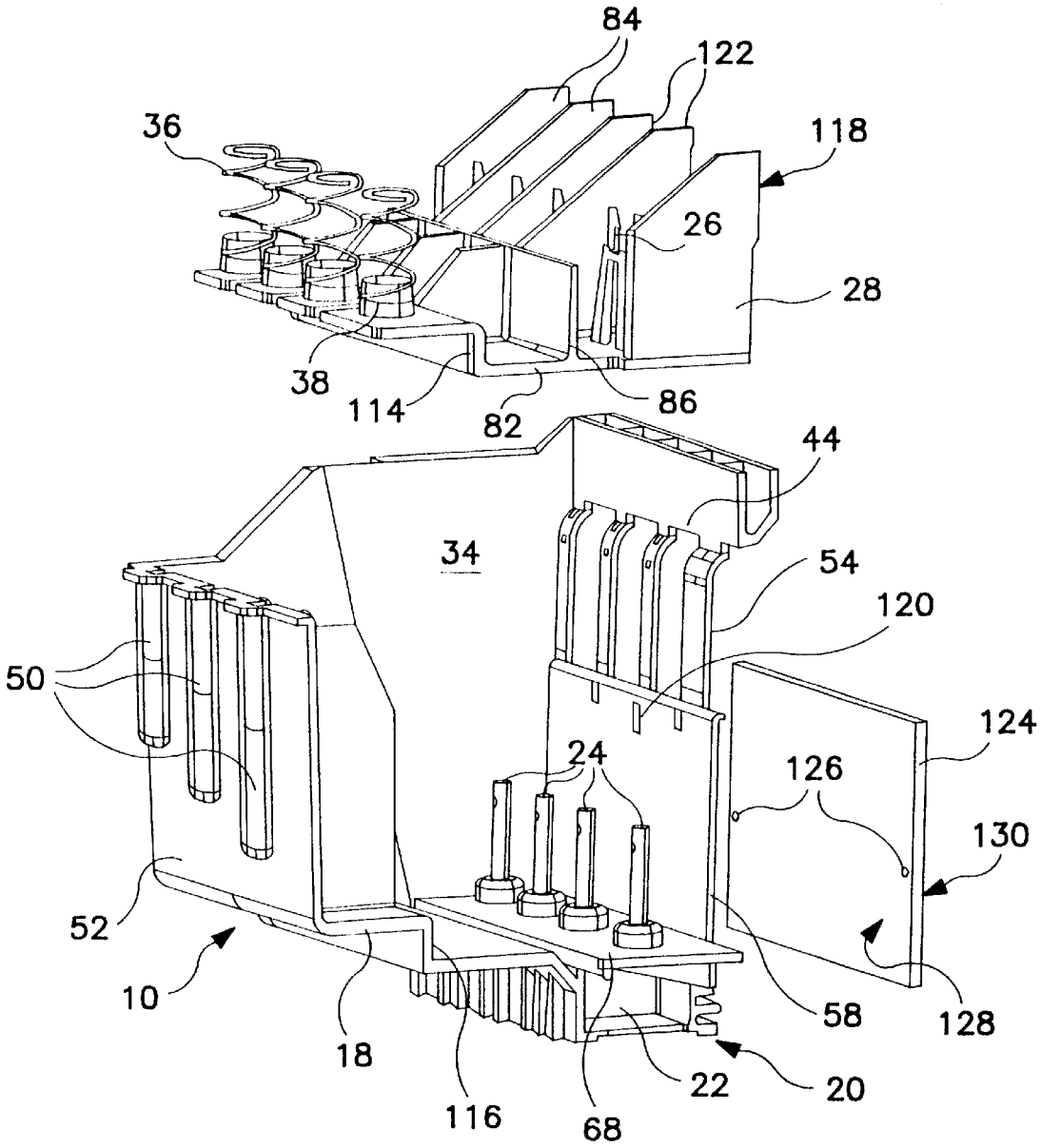
FIG. 4 is a partial cut-away exploded view of a cartridge body in and a stiffener in perspective.

The stiffener insert 28 is designed to be snappingly attached to the cartridge body 10 in cavity 34 as shown in FIG. 4 so that the apertures 108 in valve seal assemblies 26 slidably engage ink needles 24. Accordingly, the bottom wall portion 82 of the stiffener insert 28 preferably contains an elbow section 114 which is dimensioned to frictionally engage shoulder section 116 of bottom panel member 18 of the cartridge body 10. Upon engagement between elbow section 114 and shoulder section 116, front edges 118 of dividing wall portions 84 preferably engage the inside of the lower section 58 of the front panel 54. One or more apertures 120 may be provided in the lower section 58 for engaging tabs 122 on the front edges 118 of dividing wall portions 84. It is also preferred that cross wall portions 86 contact side panels 60 to reduce flexure of the side panels 60 and to provide further frictional engagement between the stiffener insert 28 and the cartridge body 10.

An important advantage of the stiffener insert 28 apart from the features described above is that it enables a reduction in the overall cost of the cartridge body 10. The stiffener insert 28 is molded to contain seal assembly guides 92 for the valve seal assembly 26. Accordingly, there is no need to provide a separate needle valve seal assembly structure which must be assembled to the needles 24 in a separate production step. Furthermore, since the seal assembly guides 92 are molded as part of the stiffener insert 28 rather than molded with the cartridge body 10 itself, only the stiffener insert 28 need be replaced if one or more of the guides 92 break or are otherwise deformed during manufacture or assembly rather than replacing the entire cartridge body 10. The stiffener insert 28 may also be produced in a non-clean room atmosphere and assembled to the cartridge body 10 at an appropriate step in the production process.

With further reference to FIG. 4, the lower section 58 of front panel 54 is adapted to receive a printed circuit board (PCB) 124 which contains printer electrical contact pads, memory devices and the like for control of ink ejection from the ink jet printheads 14. The PCB 124 is preferably adhesively attached to lower section 58 using alignment holes 126 or other suitable alignment means. It is particularly preferred that the PCB 124 be supported on its entire surface 128 by lower section 58 so as to reduce flexure of the PCB 124 during connecting contact between its electrical contact pads on opposing surface 130 of the PCB 124 and a carriage in a printer device on which the cartridge body 10 is mounted. As described above, stiffener insert 28 provides support for lower section 58 and thus PCB 124 to reduce flexure thereof during electrical connection of the cartridge body 10 to an ink jet printer carriage.

Figure 5:
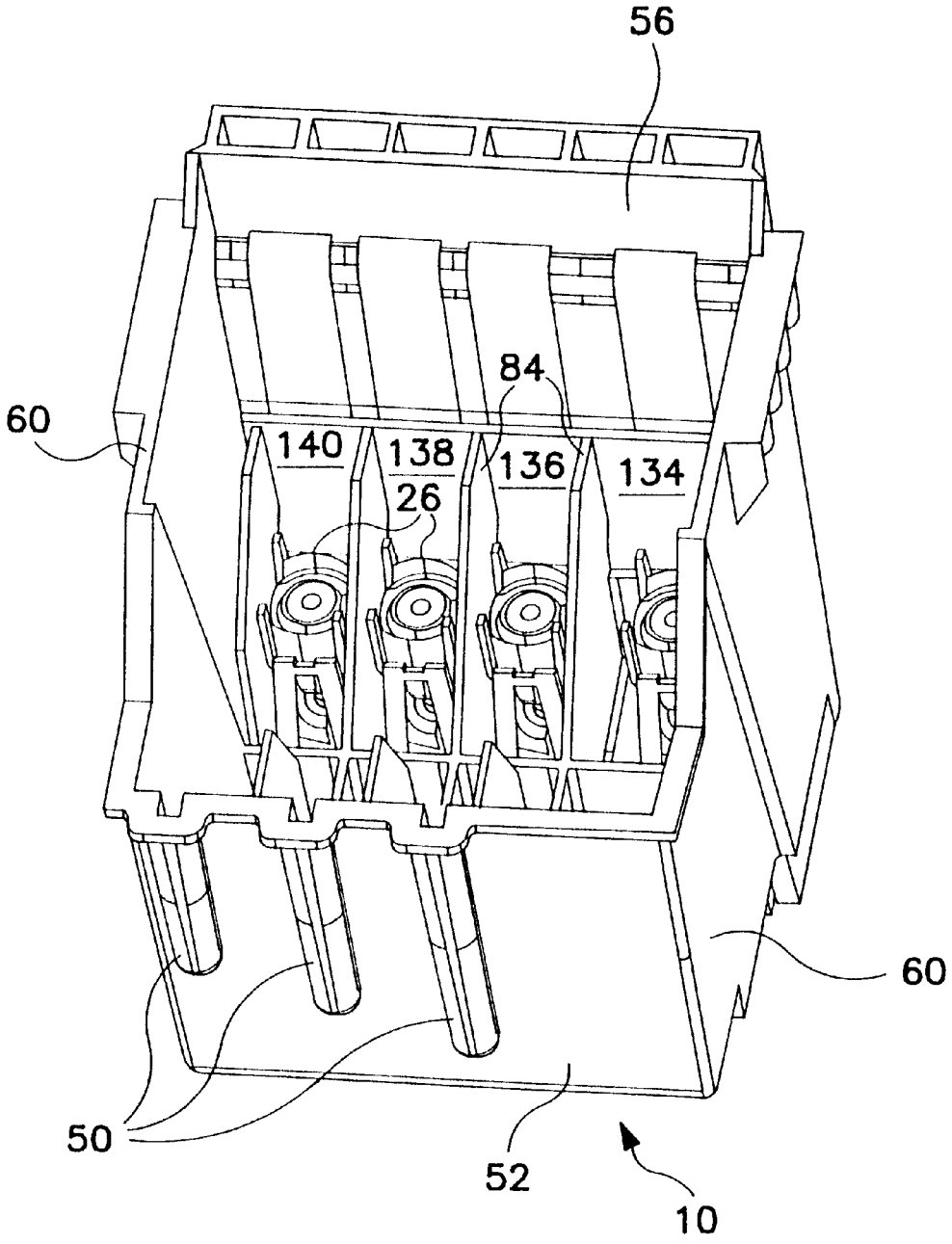
FIG. 5 is a top perspective view of an assembled cartridge body according to the invention.

A fully assembled cartridge body 10 containing ink cartridge slots 134, 136, 138 and 140 is illustrated in perspective view in FIG. 5. The cartridge slots 134, 136, 138 and 140 are defined by dividing wall portions 84 and side panels 60 and may have the same width between dividing wall portions 84 or different widths for accepting different color ink cartridges 12 therein. It is particularly preferred to include a wider slot 134 for a black ink cartridge and to provide substantially the same width slots 136, 138 and 140 for cyan, magenta and yellow ink cartridges 12. In order to assure proper placement of the cyan, magenta and yellow ink cartridges 12 with respect to the cartridge body 10, the cartridges 12 may contain keys for engagement with keying members 50. The keying members 50 may have different widths, different lengths, be disposed in different locations relative to their corresponding cartridge slots 136, 138 and 140 or a combination of any two or more of the foregoing to provide proper insertion of the ink cartridges 12 on the cartridge body 10.

Having described herein various aspects and embodiments of the invention and several advantages thereof, it will be recognized by those of ordinary skills that the invention is susceptible to various modifications, substitutions and revisions within the spirit and scope of the appended claims.

What is claimed is:

1. A cartridge body for an ink jet printer which comprises:

a substantially one-piece molded body structure defining one or more ink cartridge positions, the body structure being mountable on a printer carriage and being molded to include a front panel member opposite a back panel member, side panel members connected to the front and back panel members and a bottom panel member having a ink cartridge side and a printhead side connected to a lower edge of each of the front, back and side panel members so as to define an open ended cartridge cavity with the ink cartridge side of the bottom panel member facing the cartridge cavity;

one or more printhead locations provided on the printhead side of the bottom panel member, each printhead location corresponding to one of the ink cartridge positions in said cartridge cavity;

one or more ink cavities integrally molded in the body structure providing one ink cavity opposite each printhead location;

an ink needle panel member containing an ink needle for each ink cavity, the ink needle being attached to the ink needle panel and the ink needle panel member being attached to the bottom panel member adjacent the one or more ink cavities providing closed ink cavities; and a filter element disposed in each of the ink cavities for filtering ink to printheads attached to each printhead location, the filter element being disposed between the ink needle panel member and the bottom panel member.

2. The cartridge body of claim 1 wherein the ink needle panel member contains alignment members and the bottom panel member contains member receivers for aligning the needle panel member with respect to the ink cavity.

3. The cartridge body of claim 1 further comprising a circuit board card wall defined by a portion of the front panel member opposite the cartridge cavity.

4. The cartridge body of claim 1 further comprising a stiffener assembly attached to the molded body structure in the cartridge cavity, the stiffener assembly containing a bottom wall and one or more upstanding dividing walls attached to the bottom wall.

5. The cartridge body of claim 4 wherein the stiffener assembly further comprises an upstanding cross wall attached to the bottom wall and to the dividing walls, the cross wall being positioned transverse to the dividing walls.

6. The cartridge body of claim 4 wherein the stiffener assembly further comprises two or more valve seal assemblies and guides rails therefor, the guide rails being attached to the bottom wall between the dividing walls for slidably guiding the valve seal assemblies along an axis which is substantially perpendicular to the bottom wall.

7. The cartridge body of claim 6 wherein the stiffener assembly further comprises two or more urging members attached to the bottom wall for urging ink cartridges in a direction away from said bottom wall.

8. The cartridge body of claim 6 wherein the stiffener assembly fittingly snaps into said cartridge cavity so that said valve seal assemblies slidably engage said ink needles.

9. A method for constructing a cartridge body for an ink jet printer, which comprises:

molding a cartridge body from a polymeric material, the molded cartridge body defining one or more ink cartridge positions and being removably mountable on a printer carriage, the cartridge body being molded to include a front panel member opposite a back panel member, side panel members connected to the front and back panel members and a bottom panel member having a ink cartridge side and a printhead side connected to lower edges of each of the front, back and side panel members so as to define an open ended cartridge cavity with the ink cartridge side of the bottom panel member facing the cartridge cavity, one or more printhead locations provided on the printhead side of the bottom panel member, each printhead location corresponding to an ink cartridge position in the cartridge cavity, and an ink cavity integrally molded in the bottom panel member of the cartridge body opposite each of the printhead locations;

providing an ink needle panel member containing an ink needle for each printhead location;

disposing a filter element for each ink cavity for filtering ink flowing to one or more printheads attached to the printhead locations, the filter element being disposed between the ink needle panel member and the bottom panel member; and fixedly attaching the ink needle panel member to a peripheral edge of the ink cavity to provide an enclosed ink filter chamber.

10. The method of claim 9 further comprising molding a stiffener assembly for attachment to the cartridge body in the cartridge cavity, the stiffener assembly containing a bottom wall and one or more upstanding dividing walls attached to the bottom wall and attaching the stiffener assembly to the cartridge body.

11. The method of claim 10 wherein the stiffener assembly contains one or more valve seal assemblies and guides therefor, the guides being attached to the bottom wall between the dividing walls for slidably guiding the valve seal assemblies for movement along an axis substantially perpendicular to the bottom wall.

12. The method of claim 10 further comprising frictionally attaching the stiffener assembly to the cartridge body by snapping the stiffener assembly into the cartridge cavity so that the valve seal assemblies slidably engage the ink needles.

13. The method of claim 10 further comprising attaching a printed circuit board to the front panel member of the cartridge body.

14. An ink cartridge body which is removably mountable on a printer carriage of an ink jet printer, the cartridge body comprising a molded polymeric structure providing an open-ended cavity therein for slidably engaging three or four ink cartridges, the cavity containing a bottom cavity wall and an integrally molded ink chamber for each ink cartridge disposed in the bottom cavity wall, each ink chamber being in flow communication with a printhead attached to a printhead location on the cartridge body, a needle panel member having attached thereto an ink needle for each ink chamber, the panel member being attached to the ink chambers so as to define closed ink chambers and filter elements disposed in each of the ink chambers between the bottom cavity wall and the panel member for filtering ink flowing to the printheads and one or more urging members in the open-ended cavity for urging the ink cartridges away from said bottom cavity wall.

15. The cartridge body of claim 14 wherein the ink needle panel member contains alignment members and the open-ended cavity contains member receivers for aligning the needle panel member with respect to the open ended cavity.

16. The cartridge body of claim 14 further comprising a circuit board card wall attached to the cartridge body external to the open-ended cavity.

17. The cartridge body of claim 14 further comprising a stiffener assembly attached to the cartridge body in the open-ended cavity, the stiffener assembly containing a bottom stiffener wall and one or more upstanding dividing walls attached to the bottom stiffener wall.

18. The cartridge body of claim 17 wherein the stiffener assembly further comprises an upstanding cross wall attached to the bottom stiffener wall and to the one or more dividing walls, the cross wall being positioned transverse to the dividing walls.

19. The cartridge body of claim 18 wherein the stiffener assembly further comprises two or more valve seal assemblies and guides therefor, the guides being attached to the bottom stiffener wall between the dividing walls for slidably guiding the valve seal assemblies for movement along an axis substantially perpendicular to the bottom stiffener wall.

20. The cartridge body of claim 19 wherein the stiffener assembly further comprises two or more urging members attached to the bottom stiffener wall for urging the ink cartridges in a direction away from said bottom stiffener wall.

21. The cartridge body of claim 19 wherein the stiffener assembly fittingly snaps into said open-ended cavity so that said valve assemblies slidably engage said ink needle.

22. A stiffener assembly for stiffening an electrical connection wall of a cartridge body for an ink jet printer, the cartridge body containing ink needles for flow of ink from ink cartridges to printheads attached to the cartridge body, the cartridge body providing a cartridge cavity adapted for insertion of the stiffener assembly and ink cartridges therein, the stiffener assembly comprising a bottom wall, one or more upstanding dividing walls attached to the bottom wall and one or more valve seal assemblies and guides therefor for the ink needles, the guides being attached to the bottom wall and, the stiffener assembly being adapted for frictional engagement in the cartridge cavity of the cartridge body.

23. The stiffener assembly of claim 22 further comprising an upstanding cross wall attached to the bottom wall and to the dividing walls, the cross wall being positioned transverse to the dividing walls.

24. The stiffener assembly of claim 22 wherein the guides are attached to the bottom wall between the dividing walls for slidably guiding the valve seal assemblies for movement substantially perpendicular to the bottom wall.

25. The stiffener assembly of claim 24 further comprising two or more urging members attached to the bottom wall for urging the ink cartridges in a direction away from said bottom wall.

26. The stiffener assembly of claim 24 wherein the stiffener assembly fittingly snaps into said cartridge cavity so that said valve seal assemblies slidably engage said ink needles in the cartridge cavity.

* * * * *